United States Patent [19]

Gilbert

[11] Patent Number: 4,711,679

[45] Date of Patent: Dec. 8, 1987

[54] HEXAKIS (2-NITROXETHYL) MELAMINE USEFUL AS AN ENERGETIC PLASTICIZER

[75] Inventor: Everett E. Gilbert, Morristown, N.J.

[73] Assignee: The United States of America as represented by the Secretary of the Army, Washington, D.C.

[21] Appl. No.: 923,447

[22] Filed: Oct. 22, 1985

[51] Int. Cl.[4] ..... C06B 25/22; C07D 251/54

[52] U.S. Cl. ..... 149/96; 149/19.8; 544/196

[58] Field of Search ..... 544/196, 194, 204; 149/100, 99, 96 O, 19.8 X; 260/688

[56] References Cited

PUBLICATIONS

J.A.C.S. 73, 2984 (1951).

Lucas, Howard, *Organic Chemistry,* 1953, pp. 244–245.

*Primary Examiner*—Henry R. Jiles

*Assistant Examiner*—Zinna Northington

*Attorney, Agent, or Firm*—Anthony T. Lane; Harold H. Card, Jr.; Edward F. Costigan

[57] ABSTRACT

Hexakis (2-nitroxyethyl) melamine which is useful as an energetic plasticizer.

2 Claims, No Drawings

HEXAKIS (2-NITROXETHYL) MELAMINE USEFUL AS AN ENERGETIC PLASTICIZER

GOVERNMENTAL RIGHTS

The invention described herein may be manufactured, used, and licensed by or for the Government for Governmental purposes without the payment to me of any royalties thereon.

FIELD OF USE

This invention relates to hexakis(2-nitroxyethyl)melamine and a process of making the same.

BACKGROUND

It is known that cyanuric chloride will react with diethanolamine to yield hexakis(2-hydroxyethyl)melamine (Jour. Am. Chem. Soc. 73,2984 (1951).

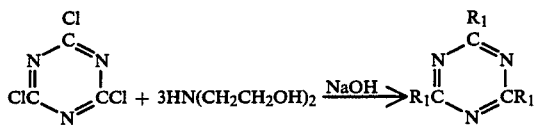

wherein $R_1$ is $N(CH_2CH_2OH)_2$

SUMMARY OF INVENTION

It has been found that the nitration of hexakis(2-hydroxyethyl)melamine yields hexakis(2-nitroxyethyl)melamine which is useful as an energetic plasticizer for gun propellants.

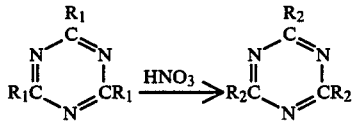

wherein, $R_1$ is $N(CH_2CH_2OH)_2$ and $R_2$ is $N(CH_2CH_2ONO_2)_2$

EXAMPLE 1

1.5 g of hexakis(2-hydroxyethyl)melamine was added at 10° C. to 10 mls of 100 percent nitric acid. The mixture was stirred for 15 minutes, yielding a clear yellow solution. The latter solution was poured on to crushed ice with stirring, yielding an oil which soon crystallized. The product was filtered, dried, and recrystallized from methanol, yielding 2.1 g of hexakis(2-nitroxyethyl)melamine having a melting point of 72° to 75° C. and representing 82 percent of theory. Elemental analysis showed 27.6 percent C. and 3.7 percent H (theoretical percent is 27.3 percent C. and 3.6 percent H). The infrared spectrum exhibited strong peaks for the nitroxyl group and the absence of peaks for the hydroxyl group. The nitrated product flashed brightly upon heating a small portion on a spatula over a small Bunsen flame which is an indication that the product is highly energetic.

EXAMPLE 2

0.5 g of hexakis(2-hydroxyethyl)melamine was added in portions at room temperature to a mixture of 10 ml. dichloromethane and 10 ml. of 100 percent nitric acid. The melamine reactant dissolved immediately, after which the mixture was stirred for one-half hour. The liquid product was added in a rapid stream to 3.5 ml. of tap water with stirring but with no external cooling. The dichloromethane solvent flashed off, yielding a heavy oil which soon crystallized. It was recrystallized from methanol yielding 71 percent of hexakis(2-nitroxyethyl)melamine.

EXAMPLE 3

The procedure of example 2 was repeated. However, in this example, 1.5 g of hexakis(2-hydroxyethyl)melamine was added to a mixture of 30 ml. of dichloromethane and 30 ml. of 100 percent nitric acid. The product yield of hexakis(2-nitroxyethyl)melamine was 78 percent.

EXAMPLE 4

The procedure of example 1 was repeated using 5.0 g. of hexakis(2-hydroxyethyl)melamine and 20 ml. of 100 percent nitric acid. the yield of recrystallized hexakis(2-nitroxyethyl)melamine was 78 percent.

The product of the foregoing examples was used to plasticize nitrocellulose, the procedure being set forth below.

EXAMPLE 5

Equal weights of nitrocellulose (13.5 percent nitrogen) and hexakis(2-nitroxyethyl)melamine each separately dissolved in acetone. The solutions were mixed and the mixture was placed in a 2½ inch Petri dish. The solvent was evaporated by a heat lamp, yielding a water-clear film which gave a positive match test. The latter being the classical method for testing of an energetic plasticizer.

Further evidence of the energetic nature of the compound was noted from the occurrence of detonation during determination of the heat of combustion by a standard procedure involving hot wire ignition under 35 atm. oxygen.

What is claimed is:

1. Hexakis(2-nitroxyethyl)melamine.

2. A mixture of equal weights of nitrocellulose and hexakis(2-nitroxyethyl)melamine.

* * * * *